US005594420A

United States Patent [19]

Copeland et al.

[11] Patent Number: 5,594,420

[45] Date of Patent: Jan. 14, 1997

[54] ROTATING MAGNET ARRAY FOR DEACTIVATING EAS MARKERS

[75] Inventors: Richard L. Copeland; Paul Manente, both of Boca Raton, Fla.

[73] Assignee: Sensormatic Electronics Corporation, Deerfield Beach, Fla.

[21] Appl. No.: 382,630

[22] Filed: Feb. 2, 1995

[51] Int. Cl.[6] ..... G08B 13/14

[52] U.S. Cl. ..... 340/572; 335/284

[58] Field of Search ..... 340/572, 551; 335/284; 235/493, 449, 450; 446/129–136

[56] References Cited

U.S. PATENT DOCUMENTS

| | | | |
|---|---|---|---|
| 3,976,296 | 8/1976 | Smith | 446/136 X |
| 4,304,060 | 12/1981 | Tanguay | 446/136 X |
| 4,499,444 | 2/1985 | Heltemes et al. | 335/284 |
| 4,574,274 | 3/1986 | Pinneo | 340/572 |
| 4,665,387 | 5/1987 | Cooper et al. | 340/572 |
| 4,684,930 | 8/1987 | Minasy et al. | 340/551 |
| 4,752,758 | 6/1988 | Heltemes | 335/284 |
| 4,838,825 | 6/1989 | Hwang et al. | 446/136 |
| 4,992,767 | 1/1990 | Hozumi et al. | 335/284 |
| 5,126,720 | 6/1992 | Zhou et al. | 340/572 |
| 5,170,045 | 12/1992 | Bengtsson | 235/462 |
| 5,225,807 | 7/1993 | Zhou et al. | 340/551 |
| 5,285,182 | 2/1994 | Zarembo | 335/284 |

FOREIGN PATENT DOCUMENTS

| | | | |
|---|---|---|---|
| 2057678 | 6/1993 | Canada | 340/551 |

*Primary Examiner*—Thomas Mullen
*Attorney, Agent, or Firm*—Robin, Blecker, Daley & Driscoll

[57] ABSTRACT

A device for deactivating a EAS marker includes a rotating support member and magnets disposed on the support member. The magnets are arranged in linear arrays, and the magnets in each array are mounted on the support member so that the upper surface of each magnet in the array has a magnetic polarity that is the opposite of the polarity of the upper surface of neighboring magnets. The support member is in the form of a thin circular platter and each array of magnets corresponds to a radius of the support member.

35 Claims, 4 Drawing Sheets

ROTATING MAGNET ARRAY FOR DEACTIVATING EAS MARKERS

BACKGROUND OF THE INVENTION

This invention relates to an apparatus for use with electronic article surveillance (EAS) systems, and in particular, to an apparatus for deactivating EAS markers used in such systems.

In the field of electronic article surveillance, EAS markers which incorporate some type of magnetic sensor assembly are placed on articles of merchandise to prevent unauthorized removal of the merchandise from a store. In a widely used type of EAS marker, the magnetic sensor assembly includes a magnetomechanical active element and a biasing or control element that is formed of a hard or semi-hard magnetic material. An EAS system using such a magnetomechanical marker is disclosed in U.S. Pat. No. 4,510,489, issued to Anderson et al.

To place the marker in an active condition, the control element is magnetized so that it provides a biasing field for the active element. The biasing field is such that the active element mechanically vibrates in response to an interrogation signal, thereby generating a detectable signal at the frequency of the interrogation signal. Deactivation of the marker is accomplished by changing the magnetic state of the control element in such a manner that the active element is no longer biased to mechanically vibrate in response to the interrogation signal.

Known types of devices for deactivating magnetomechanical EAS markers include active and passive devices. Active devices include coils, power supplies, and active electronic circuits which cause the coils to be driven with a time-varying current so as to produce a time-varying electromagnetic field. Exposing the magnetomechanical marker to this varying field causes the control element to be degaussed. As a result, the control element no longer provides a bias field for the active element, and the active element does not mechanically vibrate upon exposure to the interrogation signal.

On the other hand, passive deactivation devices do not include an active electronic element for generating an electromagnetic field. An example of a passive deactivation device will now be described with reference to FIG. 1, in which reference numeral 10 generally indicates a deactivation pad. The deactivation pad 10 includes thin strips 12-1, 12-2, 12-3, 12-4, etc. of permanently magnetized material. The strips 12 are arranged in parallel to each other extending in the longer dimension of the pad 10, and with alternating magnetic polarities. For example, the strips 12-1, 12-3, etc. (indicated by shading in FIG. 1) are arranged with a north pole upwards while the strips 12-2, 12-4, etc., interleaved with the other strips, have a south pole oriented upwardly. Typical dimensions for the pad 10 are about 4 inches by 6 inches, with each of the strips being about 0.25 inch wide so that a pole density of 4 poles per inch is provided in the direction of the width of the pad. The strips 12 are typically packaged between a keeper plate (not shown) provided underneath the strips 12 and a cover plate (also not shown) on the top of the strips 12. The overall height of the pad 10 is about 0.25 inch.

A deactivation pad 10 of the type just described is substantially less expensive to manufacture than active devices because of the absence of electronic circuitry, power supplies and so forth. However, for reasons to be described below, the deactivation pad 10 does not always function reliably to deactivate markers.

A typical marker 13 in an active state is schematically illustrated in FIG. 2. The marker 13 includes a parallelogram-shaped element of bias material 14, which functions as a control element, and is mounted in a housing 16 (indicated in phantom) with a magnetostrictive active element (not shown). The control element 14 may be formed of an alloy such as Arnokrome-3, Crovac 10/130 or Vicalloy, or of an amorphous material such as Metglas 2605 TCA (transformer core alloy—$Fe_{78}Si_9B_{13}$) annealed according to a process disclosed in U.S. Pat. No. 5,351,033 so that the amorphous material is crystallized and exhibits semi-hard magnetic properties. To place the marker in an active condition, the control element 14 is magnetized along its length to form magnetic pole regions 18 and 20. For example, the pole region 18 may be a north magnetic pole in which case the pole region 20 is a south magnetic pole. A typical length for the control element 14 is about 1½ inches.

The marker 13 is deactivated by being brought into contact with, or swept across, the top surface of the pad 10. If this is done with the marker oriented as indicated by the double arrow 22 (FIG. 1), i.e. with the marker extending transversely across several of the strips 12, then the alternating polarity of the strips causes the pattern of magnetization of the control element 14 to be broken up along the length of the control element. In this condition, the control element 14 does not provide a bias field that will result in a substantial magnetomechanical response by the active element of the marker. However, if the marker, when placed in contact with the pad 10, is oriented as indicated by the double arrow 24, i.e. with its length extending in the same direction as the strips 12, then the contact with the pad 10 results in a condition like that illustrated in FIG. 3. As shown in FIG. 3, the pattern of magnetization of the control element 14 resulting from contact with the pad 10 includes pole regions 26, 28 and 30 which extend along substantially the entire length of the control element 14. With the pattern of magnetization shown in FIG. 3, the control element 14 typically continues to exhibit a degree of remanent magnetization along its length and may be capable of providing a sufficient bias field along its length to cause the active element to exhibit a magnetomechanical response to an interrogation signal. As a consequence, the marker remains active and may generate a false alarm.

It is, therefore, an object of the present invention to provide an improved apparatus for deactivating magnetomechanical EAS markers.

It is a further object of the present invention to provide a marker deactivating apparatus that is both reliable and relatively inexpensive.

SUMMARY OF THE INVENTION

In accordance with the principles of the present invention there is provided an apparatus for deactivating an electronic article surveillance marker, including a substantially planar support member, a mechanism for rotating the support member in the plane of the support member and around a center of rotation, and a magnetic structure disposed on the support member for forming at least one linear array of magnetic field regions having respective polarities that alternate in space. According to a further aspect of the invention, the magnetic structure forms a plurality of linear arrays of magnetic field regions having respective polarities that alternate in space. According to further aspects of the invention, all of the linear arrays meet at the center of rotation, or the magnets are formed into two linear arrays arranged in parallel to each other on respective opposite sides of a diameter of the support member.

According to yet another aspect of the invention, the magnetic structure includes a linear array of cylindrical magnets and, in each of the linear arrays, each pair of adjacent magnets of the array consists of a magnet having its north pole oriented upwardly and a magnet having its south pole oriented upwardly. According to a preferred embodiment of the invention, the support member is circular, the magnets have a diameter of about 0.635 mm and are arranged in eight linear arrays, each of the arrays corresponds to a respective radius of the support member, and all eight arrays meet at the center of rotation of the support member.

Provision of a rotating magnetic array in accordance with the invention allows for reliable deactivation of a magnetomechanical marker, regardless of the orientation of the marker when it is brought into contact with the deactivation device.

According to still another aspect of the invention, there is provided a method of deactivating an electronic article surveillance marker, including the steps of mounting a plurality of magnets substantially in a plane, moving the mounted magnets within the plane according to a repetitive pattern of movement, and placing the marker in proximity to the magnets during the movement of the magnets. According to further practice in accordance with this aspect of the invention, the repetitive pattern of movement is rotational and at least some of the magnets are arranged in an array such that adjacent magnets in the array have respective regions of like magnetic polarities oriented in opposite directions. According to still further practice in accordance with this aspect of the invention, the marker to be deactivated is a magnetomechanical marker that includes a bias magnet and the step of placing the marker in proximity to the moving magnets causes a rearrangement of a pattern of magnetic domains in the bias magnet. According to further practice in accordance with this aspect of the invention, the repetitive pattern of movement has a period of repetition of no more than about one-sixtieth of a minute.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE PREFERRED EMBODIMENTS

Figure 4:
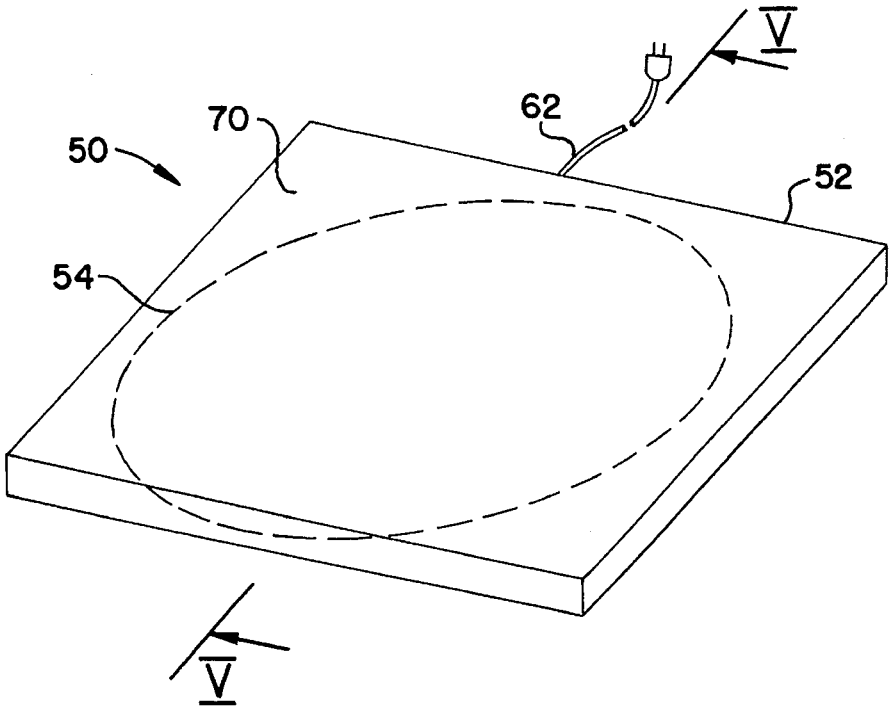
FIG. 4 is a perspective view of a deactivation device provided in accordance with the present invention.
Figure 5:
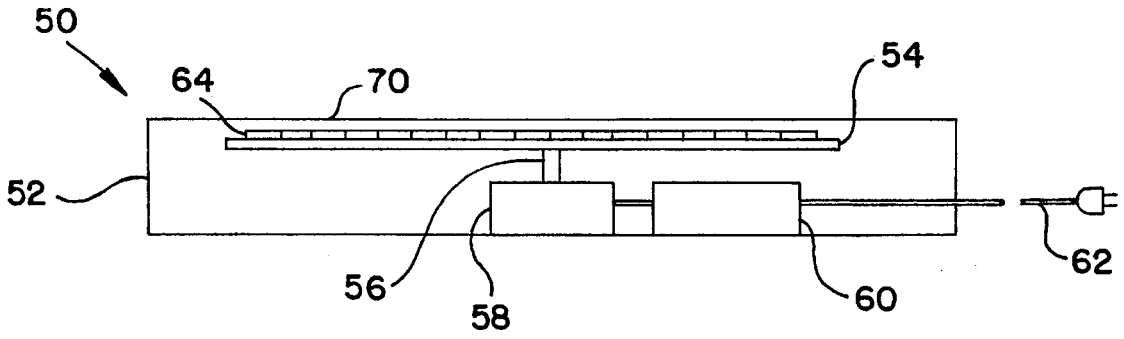
FIG. 5 is a sectional view of the deactivation device of FIG. 4 taken along the line V—V of FIG. 4.
Figure 6:
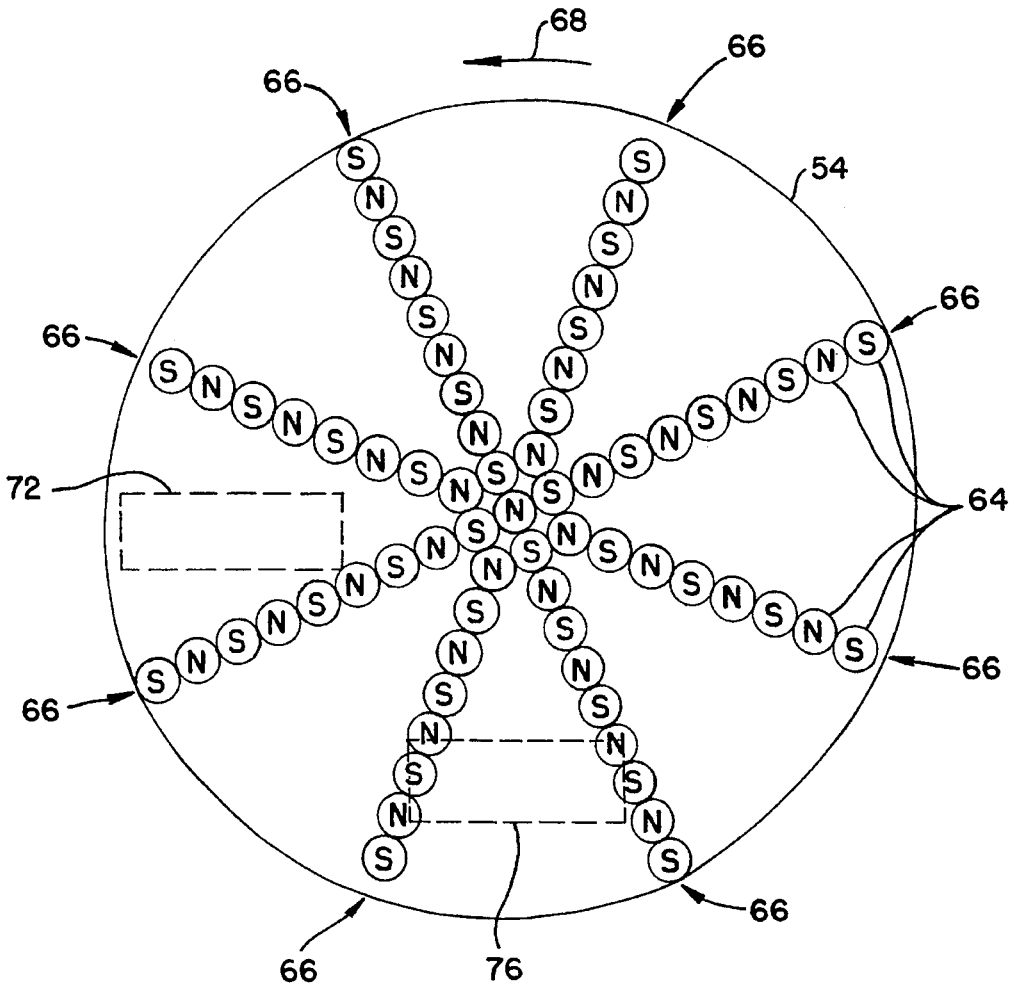
FIG. 6 is a plan view of the device of FIG. 4 with the housing of the device removed.

As illustrated in FIGS. 4–6, a deactivation device 50 in accordance with the invention includes a housing 52 which contains a support plate 54. The plate 54 is in the shape of a flat, round platter and is mounted for rotation with a spindle 56. The spindle 56 is located at the center of the circular profile of the plate 54. The spindle 56 is driven by a motor 58 to rotate with the plate 54. Power for the motor 58 is provided via a power supply 60 and a power cord 62 which is adapted to be plugged into a conventional power outlet. The plate 54 has mounted thereon a number of small, thin, cylindrical magnets 64, according to a mounting pattern best seen in FIG. 6. As shown in FIG. 6, the magnets 64 are arranged in a number of linear arrays 66 (eight such arrays shown in FIG. 6), each of which is arranged along a respective radius of the plate 54. The arrays 66 meet at a central point on the support plate 54, which is also the center of rotation of the plate 54. It is preferred that the arrays 66 be arranged at equal angular intervals (e.g., 45° intervals as shown in FIG. 6) with respect to the support plate 54.

As indicated above, each magnet 64 is in the shape of a thin disk or cylinder. The opposite sides of the cylindrical magnets 64 have opposite magnetic polarities. That is, one side is a north pole and the other side is a south pole. The magnets 64 arranged in each of the linear arrays 66 are disposed on the plate 54 so that the upwardly oriented face of each of the magnets has the opposite magnetic polarity from the upwardly oriented face of its neighboring magnet or magnets. In other words, the upwardly oriented faces of the magnets in each array 66 are arranged according to the pattern south, north, south, north, etc.

The magnets 64 are preferably permanent magnets, composed, for example, of Neodymium Iron Boron, with a diameter of about 6.35 mm and a thickness of about 2.5 mm. The support plate 54 may be formed of a ferromagnetic material such as carbon steel or 430 stainless steel, with a thickness of about 0.020 inches and a diameter of about 6 to 7 inches. Assuming that the magnets 64 have the above-mentioned diameter of 0.635 mm, it will be appreciated that approximately 12 magnets may be arranged in each linear array 66 on a support plate of 6 or 7 inches in diameter. (It is noted that this is a somewhat larger number of magnets 64 than is actually shown in FIG. 6).

If the plate 54 is of a ferromagnetic material, magnetic attraction between the magnets 64 and the plate 54 may be sufficient to maintain the magnets 64 in place on the plate 54. It is also contemplated to mount the magnets 64 on the plate 54 by means of a chemical adhesive such as epoxy, or by embedding, etc., in which cases, the plate 54 may be selected to be of a non-magnetic material.

The power supply 60, motor 58 and spindle 56 are operative to rotate the support plate 54 at a rate of about 60–100 r.p.m., for example. It is immaterial whether the direction of rotation is counterclockwise (as indicated by arrow 68 in FIG. 6) or clockwise. A higher rotational rate would make it possible to provide a smaller number of arrays 66 of magnets on the plate 54 without adversely affecting deactivation, but such an increased rate of rotation would require a more expensive motor 58 and perhaps also greater expense in terms of supporting the plate 54 for rotation. On the other hand, equally effective deactivation could be achieved at a lower rotational rate by providing a greater number of arrays 66 on the plate 54.

The representation in FIG. 5 of the spindle 56, motor 58 and power supply 60 should be understood as being somewhat schematic, inasmuch as the mechanism for rotating the plate 54 can be provided in a number of forms including, for example, a mechanism like that used for rotating a compact disc in a CD player.

The housing 52 must be non-magnetic, and is preferably formed of a thin and rigid material, such as aluminum or suitably reinforced plastic. It is desirable that an upper surface of the housing 52 be located quite close to the top surfaces of the magnets 64. For example, in a preferred embodiment of the invention, a top wall 70 of the housing 52 is on the order of 0.10 to 0.20 inches thick and is a vertical distance of about 0.030 to 0.050 inches above the top surfaces of the magnets 64. It is accordingly desirable that the material of at least the top wall 70 of the housing 52 be sufficiently strong and rigid to prevent the wall 70 from bowing and coming into contact with either the magnets 64 or the plate 54.

The overall dimensions of the housing 52, and hence the deactivation device 50, may be about one-half inch high by 7 inches square. It will be recognized that the height of the device 50 is somewhat exaggerated in FIG. 5.

An on-off switch (not shown) may be provided to turn the motor 58 on and off and thus to start or stop rotation of the support plate 54. Alternatively, rotation of the plate 54 may be started or stopped simply by inserting the power cord 62 in, or removing the cord 62 from, a power outlet.

Figure 7:
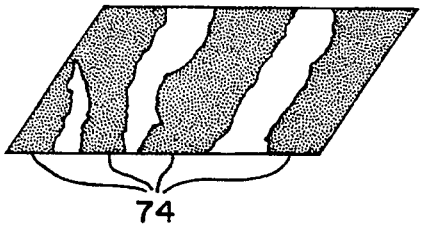
FIGS. 7 and 8 respectively illustrate magnetic domain patterns in a control element of a magnetic marker which result from bringing the marker in contact with a top surface of the device of FIG. 4.

In operation, the motor 58 is turned on to cause the support plate 54 to rotate. Then, a magnetomechanical marker to be deactivated is brought into contact with, or swept a very short distance over, the top wall 70 of the device 50. If the marker is placed in contact with the device 50 at a radial orientation relative to the support plate 54 (as indicated by phantom box 72 in FIG. 6), the rotating array of magnets 64 causes the control element of the marker to assume a magnetic state as illustrated in FIG. 7. In FIG. 7, magnetic pole regions 74 are formed in bands that extend transversely across the control element. This is similar to the magnetization pattern that results when a marker is placed in the orientation 22 (FIG. 1) on the above-described prior art deactivation pad 10, and results in quite effective deactivation of the marker.

Figure 8:
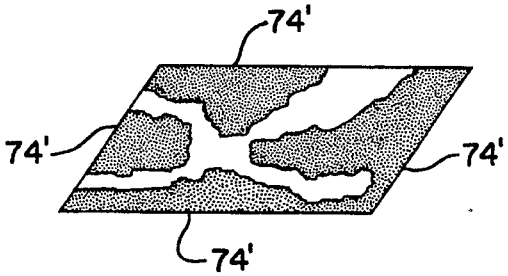

On the other hand, if the marker is placed in a tangential orientation relative to the support plate 54 (indicated by phantom box 76 in FIG. 6), a very irregular pattern of pole regions 74' is formed, as shown in FIG. 8. The magnetization pattern shown in FIG. 8 also results in very effective deactivation of the marker. It has been found that any orientation of the marker between the orientations 72 and 76 also results in a magnetization pattern that effectively deactivates the marker. Consequently, the orientation at which the marker is presented to the deactivation device 50 is not critical, and reliable deactivation of the marker can be obtained regardless of the orientation at which the marker is presented.

It is believed that a magnetomechanical marker deactivated by the device 50 disclosed herein would not generate substantial harmonic signals in response to interrogation signals generated by harmonic-type EAS systems because of the remanent magnetization pattern exhibited by the control element when the marker is in its deactivated state. Magnetomechanical markers deactivated by the inventive deactivation device would therefore be unlikely to cause false alarms in response to harmonic-type EAS systems.

Various types and shapes of magnets may be used for the magnets 64, but the magnets used should have high retentivity, remanence and coercive force. The alternative shapes may include, for example, small squares or rectangles of magnetic material. It is also within the contemplation of the invention to mount on the plate 54 an array of thin magnetic strips like the array of strips shown in FIG. 1. For such purposes, it will be understood that it may be preferable to remove the corners of the array of FIG. 1 to form that array in a circular shape, although all the strips would remain parallel to a single diameter of the resulting circle. Nevertheless, it is believed that superior results are obtained with the array of magnets shown in FIG. 6, rather than a modified version of the array of FIG. 1.

Another preferred embodiment of the invention will now be discussed with reference to FIG. 9, which shows only two linear arrays 66' mounted on the support plate 54. The arrays 66' are mounted on opposite sides of and parallel to a diameter D of the circular plate 54. An air gap is formed between the arrays 66', which are preferably equal in length to each other and substantially equal in length to the diameter D. As was the case with arrays 66 of FIG. 6, neighboring magnets in the arrays 66' are of opposite polarity. Also, corresponding magnets of the respective arrays are of opposite polarities. For example, the leftmost magnet of one array has its south pole oriented upwardly, and the leftmost magnet of the other array has its north pole oriented upwardly. Similarly, the respective rightmost magnets of the two arrays are of opposite polarity.

Figure 9:
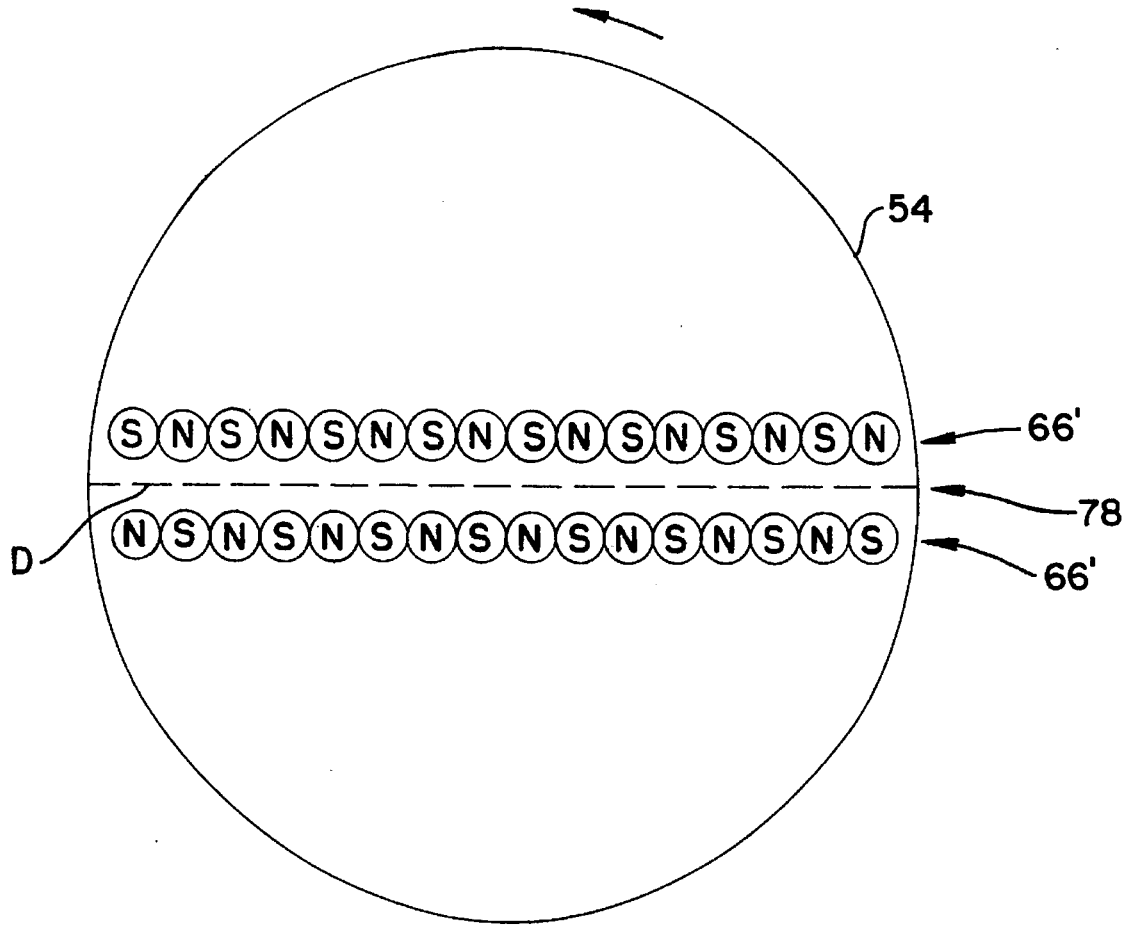
FIG. 9 is a plan view, with the housing removed, of another embodiment of the invention.

With the previously described preferred dimensions of the support plate 54 and the magnets in the arrays 66', it will be recognized that each of the arrays 66' includes 20 or more (perhaps 24) magnets, although a smaller number of magnets is actually shown in FIG. 9. It has been found that a rotating plate having the arrays of magnets shown in FIG. 9 produces results that are equivalent to those obtained with the more complex arrangement of FIG. 6 at comparable rotation rates.

Figure 1:
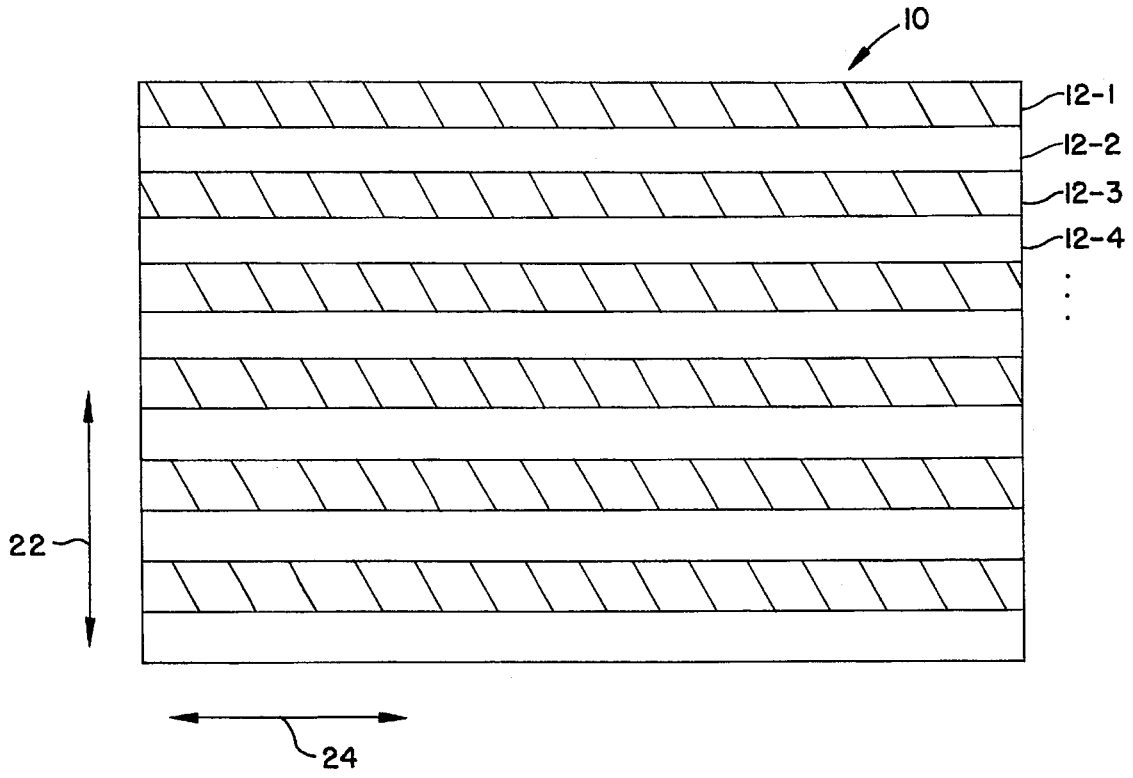
FIG. 1 (PRIOR ART)
FIG. 1 is a schematic plan view of a passive deactivation pad device according to the prior art.
Figure 2:
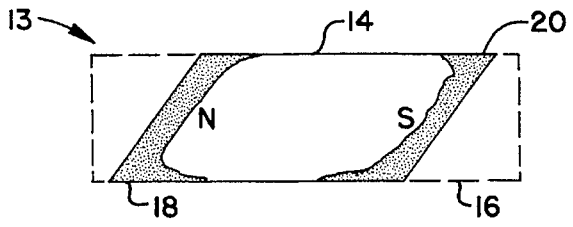
FIG. 2 (PRIOR ART)
FIG. 2 is a schematic illustration of a pattern of magnetization of a control element in a magnetomechanical EAS marker when the control element is in a condition to render the marker active.
Figure 3:
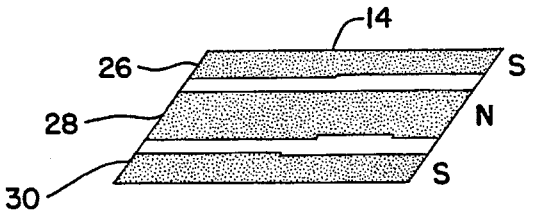
FIG. 3 (PRIOR ART)
FIG. 3 is a schematic illustration of a pattern of magnetization of the control element of FIG. 2 after the marker has been brought into contact with the deactivation pad device of FIG. 1 in a manner such that reliable deactivation is not achieved.

According to the principles of the invention, the movement of the array of magnets need not be rotational. For example, an array of magnets such as is shown in FIGS. 1, 6 or 9 could be moved in reciprocating fashion within the plane of the array of magnets. In the case of the arrays of FIGS. 1 or 9, the direction of reciprocation could be at an angle of 45° or 90° with respect to the longitudinal direction of the strips 12.

It is also contemplated to use magnets that are larger or smaller, and/or of different material, as compared to the 6.35 mm Neodymium Iron Boron magnets previously described. Using magnets having a larger diameter, and/or of a material which exhibits greater retentivity, remanence and coercive force, would result in a magnetic field that extends further above the top surface of the device. This would make it possible to deactivate markers that are not brought quite as close to the top surface, but would carry the disadvantage of possibly damaging magnetic articles of merchandise, such as pre-recorded video or audio tapes. Using magnets with a smaller diameter would enhance the effectiveness of the device in terms of breaking up the magnetic pattern of the control element, but would result in the magnetic field being confined more closely to the top of the deactivation device.

The Nd—Fe—B magnets are preferred because the strong magnetic field provided by those magnets permits the top surface of the deactivation device to be separated from the magnets by a sufficiently large distance to assure that the top surface does not contact the rotating support plate. The field provided by the preferred magnets is also such that, by suitable dimensioning of the device housing, an effective field for deactivation can be closely confined to the top of the housing and thus prevented from damaging prerecorded magnetic tape and the like.

It is contemplated to use the device disclosed herein for deactivating other types of markers in addition to magnetomechanical markers. For example, certain types of harmonic markers include a control element such that the marker can be deactivated by changing the magnetic domain pattern in the control element. The presently disclosed device can be used to deactivate such harmonic markers.

In all cases, it is to be understood that the above-described embodiments are merely illustrative of the many possible specific embodiments which represent applications of the present invention. Numerous and varied other configurations can be readily devised in accordance with the principles of the present invention without departing from the spirit and scope of the invention.

What is claimed is:

1. An apparatus for deactivating an electronic article surveillance marker, comprising:

a substantially planar support member;

means for rotating the support member in the plane of the support member and around a center of rotation; and magnet means disposed on the support member for forming at least one linear array of magnetic field regions having respective polarities that alternate in space.

2. An apparatus according to claim 1, wherein the magnet means forms a plurality of linear arrays of magnetic field regions having respective polarities that alternate in space, and all of the linear arrays meet at the center of rotation.

3. An apparatus according to claim 1, wherein said magnet means includes a linear array of magnet elements, each two adjacent elements of the array of elements consisting of an element having its north pole oriented upwardly and an element having its south pole oriented upwardly.

4. An apparatus according to claim 3, wherein the support member is of ferromagnetic material and the magnet elements are held on the support member by magnetic attraction.

5. An apparatus according to claim 3, wherein the magnet elements are held on the support member by a chemical adhesive.

6. An apparatus according to claim 3, wherein each magnet element is cylindrically shaped.

7. An apparatus according to claim 6, wherein each magnet element has a diameter equal to or less than 6.35 mm.

8. An apparatus according to claim 6, wherein each magnet element is composed of Neodymium Iron Boron.

9. An apparatus according to claim 1, wherein:

the support member is substantially circular;

the magnet means includes plural disk-shaped magnets arranged in a plurality of linear arrays; and in each of the linear arrays of magnets, each two adjacent magnets of the array consist of a magnet having its north pole oriented upwardly and a magnet having its south pole oriented upwardly.

10. An apparatus according to claim 9, wherein each of the linear arrays of magnets corresponds to a respective radius of the support member.

11. An apparatus according to claim 10, wherein each of the linear arrays of magnets includes at least eight magnets.

12. An apparatus according to claim 10, wherein the linear arrays of magnets are arranged on the support member at equal angular intervals.

13. An apparatus according to claim 12, wherein the plurality of linear arrays of magnets consists of eight linear arrays arranged at intervals of 45° on the support member.

14. An apparatus according to claim 10, wherein the center of rotation coincides with a geometric center of said circular support member.

15. An apparatus according to claim 9, wherein all of the magnets on the support member are formed in two linear arrays arranged in parallel to each other on respective opposite sides of a diameter of the support member.

16. An apparatus according to claim 15, wherein the two linear arrays are substantially equal in length to each other and to said diameter of the support member.

17. An apparatus according to claim 15, wherein the two linear arrays are separated by an air gap.

18. An apparatus according to claim 15, wherein each of the linear arrays of magnets includes at least 20 magnets.

19. An apparatus according to claim 1, wherein the support member is rotated at a rate of about 60 to 100 r.p.m.

20. An apparatus according to claim 1, further comprising a housing for housing the support member, the means for rotating and the magnet means.

21. An apparatus according to claim 20, wherein said housing has a substantially planar top wall disposed no more than about 0.100 in. above the magnet means.

22. A method of deactivating an electronic article surveillance marker, comprising the steps of:

providing a substantially planar support member having magnetic means disposed on the support member for forming at least one linear array of magnetic field regions having respective polarities that alternate in space;

rotating the support member in the plane of the support member and around a center of rotation; and placing the marker in proximity to the rotating support member.

23. A method according to claim 22, wherein the marker is a magnetomechanical marker that includes a bias magnet, and the step of placing the marker in proximity to the rotating support member causes a rearrangement of a pattern of magnetic domains in the bias magnet.

24. A method according to claim 22, wherein the support member is substantially circular, the magnetic means includes a plurality of linear arrays of discrete cylindrical magnets, and, in each of the linear arrays of magnets, each pair of adjacent magnets consists of a magnet having its north pole oriented upwardly and a magnet having its south pole oriented upwardly.

25. A method according to claim 24, wherein each of the linear arrays of magnets corresponds to a respective radius of the support member.

26. A method according to claim 24, wherein all of the magnets on the support member are formed in two linear arrays arranged in parallel to each other on respective opposite sides of a diameter of the support member.

27. A method according to claim 22, wherein the support member is rotated at a rate of about 60 to 100 r.p.m.

28. A method of deactivating an electronic article surveillance marker, comprising the steps of:

mounting a plurality of magnets on a substantially planar support member;

moving the support member according to a repetitive pattern of movement; and placing the marker in proximity to the magnets during said movement of the support member.

29. A method according to claim 28, wherein the repetitive pattern of movement is rotational.

30. A method according to claim 28, wherein said plurality of magnets includes magnets arranged in an array such that adjacent magnets in the array have respective regions of like magnetic polarity oriented in opposite directions.

31. A method according to claim 28, wherein the marker is a magnetomechanical marker that includes a bias magnet and the step of placing the marker in proximity to the moving magnets causes a rearrangement of a pattern of magnetic domains in the bias magnet.

32. A method according to claim 28, wherein the repetitive pattern of movement has a period of repetition of no more than about one-sixtieth of a minute.

33. An apparatus for deactivating an electronic article surveillance marker, comprising:

a substantially planar support member;

a plurality of magnets mounted on said support member, said plurality of magnets including magnets arranged in an array such that adjacent magnets in the array have respective regions of like magnetic polarity oriented in opposite directions; and means for moving the support member according to a repetitive pattern of movement.

34. An apparatus according to claim 33, wherein the means for moving comprises means for rotating the support member.

35. An apparatus according to claim 33, wherein the repetitive pattern of movement has a period of repetition of no more than about one-sixtieth of a minute.

* * * * *

UNITED STATES PATENT AND TRADEMARK OFFICE

CERTIFICATE OF CORRECTION

PATENT NO. : 5,594,420

DATED : January 14, 1997

INVENTOR(S) : Copeland et al.

It is certified that error appears in the above-identified patent and that said Letters Patent is hereby corrected as shown below:

Col. 4, line 49, delete "0.635" and insert – 6.35 –.

Signed and Sealed this

Thirty-first Day of March, 1998

Bruce Lehman

BRUCE LEHMAN

*Commissioner of Patents and Trademarks*

*Attest:*

*Attesting Officer*